United States Patent [19]

Baba et al.

[11] Patent Number: 4,905,982

[45] Date of Patent: Mar. 6, 1990

[54] DOUBLE-BLANK DETECTING APPARATUS FOR USE IN DESTACKER

[75] Inventors: Kiyokazu Baba; Takashi Moriyasu, both of Komatsu, Japan

[73] Assignee: Kabushiki Kaisha Komatsu Seisakusho, Tokyo, Japan

[21] Appl. No.: 124,209

[22] PCT Filed: Mar. 11, 1987

[86] PCT No.: PCT/JP87/00150

§ 371 Date: Jan. 11, 1988

§ 102(e) Date: Jan. 11, 1988

[87] PCT Pub. No.: WO87/05588

PCT Pub. Date: Sep. 24, 1987

[30] Foreign Application Priority Data

Mar. 11, 1986 [JP] Japan ..... 61-33953[U]

[51] Int. Cl.[4] ..... B65H 7/12

[52] U.S. Cl. ..... 271/262; 271/91

[58] Field of Search ..... 271/262, 255, 259, 258, 271/91, 97, 104, 107, 263; 414/676

[56] References Cited

U.S. PATENT DOCUMENTS

| | | | |
|---|---|---|---|
| 2,517,379 | 8/1950 | Backboase | 271/262 |
| 3,185,473 | 5/1965 | Miaskoss et al. | 271/262 |
| 3,194,554 | 7/1965 | Hilpman et al. | 271/262 |
| 4,804,173 | 2/1989 | Pol et al. | 271/263 |

FOREIGN PATENT DOCUMENTS

| | | |
|---|---|---|
| 54-12671 | 4/1973 | Japan . |
| 55103026 | 12/1973 | Japan . |
| 49-40504 | 11/1974 | Japan . |
| 4940504 | 11/1974 | Japan . |
| 47-40452 | 9/1976 | Japan . |
| 3614083 | 8/1983 | Japan . |
| 59-74315 | 9/1984 | Japan . |
| 56-165529 | 10/1984 | Japan . |
| 55116728 | 6/1986 | Japan . |
| 50-67578 | 12/1986 | Japan . |
| 60-52036 | 6/1987 | Japan . |

*Primary Examiner*—Joseph J. Rolla
*Assistant Examiner*—Kenneth Noland
*Attorney, Agent, or Firm*—Armstrong, Nikaido, Marmelstein, Kubovcik & Murray

[57] ABSTRACT

A double-blank detecting apparatus for use in a destacker and comprises a plurality of rows of fixtures. Each row of fixtures is parallel with the direction of conveyance of blanks and includes a plurality of fixtures. Each fixture is mounted on the frame of the destacker in such a manner that it can be moved up and down by means of a lift cylinder. The double-blank detecting apparatus further has an attractor mounted on the fixtures, and a plurality of rows of conveyor having attracting functions which extend in parallel relationship with one another and with the direction of conveyance of blanks and mounted between the rows of fixtures. Further, each fixture in at least any one of the rows has a contact type sensor mounted thereon so that it can be moved up and down freely relative to the blanks having been attracted by the attractor.

1 Claim, 3 Drawing Sheets

DOUBLE-BLANK DETECTING APPARATUS FOR USE IN DESTACKER

TECHNICAL FIELD OF THE INVENTION

This invention relates to a double-blank detecting apparatus for use in a destacker for conveying a plurality of stacked-up sheet shaped blank materials to a working apparatus such as a press machine or the like.

BACKGROUND TECHNIQUE OF THE INVENTION

In a destacker which comprises a plurality of attractor means having vacuum cups or magnets etc. and which are mounted on the body frame in such a manner that they can be moved up and down freely, the attractor means serving to attract sheet-shaped blank materials from the stack one by one, and conveyor means having attracting function for conveying the blank materials to a working apparatus such as a press machine etc., there is a tendency of occurrence of two sheets or more of blank materials being attracted at one time by the attractor means due to the attracting action of oil deposited thereon; that is; so-called "double-blank" phenomenon. If and when the double blanks are conveyed or supplied to the press machine as they are, the metal molds thereof is damaged. Accordingly, it is necessary to detect the double blanks and prevent them from being conveyed to the press machine as they are.

In the prior art double-blank detecting apparatus as disclosed, for example, in Japanese Patent Publication No. SHO54-12671 (AIDA ENGINEERING CO., LTD), there is known an apparatus for detecting the thickness of the blanks by means of a contact type sensor in the course of conveyance or the like.

In such a prior art double-blank detecting apparatus, it is essential to ensure that the contact type sensor is brought into contact with the blank being conveyed. However, the sensor mounting condition in the prior art double-blank detecting apparatus has the following disadvantage. For example, in case of detecting the double-blank in the course of lifting the blank by means of an attractor, a detection error tends to occur because the attractor means and the blank are moving upwards when the detection is made, and further there may occur an error in the contact of the sensor with the blank incidental to the vertical movement of the attractor means thus making it impossible to ensure that the sensor is brought into contact with the blank. Moreover, in case blanks are detected in the course of conveyance of them to a press machine, in order to ensure that the detection is made in a limited space, it is essential to stop the conveyance temporarily and detect the double-blank phenomenon. This will cause a problem on lowering of the working efficiency.

SUMMARY OF THE INVENTION

The present invention has been devised in view of the above-mentioned situation in the prior art apparatuses, and has for its object to provide a double-blank detecting apparatus for use in a destacker, capable of ensuring that a contact type sensor is brought into contact with the blank being conveyed without interrupting the conveyance thereby making it possible to detect double blanks without fail.

To achieve the above-mentioned object, according to the present invention, there is provided a doubleblank detecting apparatus for use in a destacker, comprising a plurality of rows of fixtures, each of the rows of fixtures being parallel with the direction of conveyance of blanks and including a plurality of fixtures, each of the fixtures being mounted on the frame of the destacker in such a manner that it can be moved up and down by means of a light cylinder; attractor means mounted on the fixtures, respectively; and a plurality of rows of conveyor means having attracting function extending in parallel relationship with one another and with the direction of conveyance of blanks and mounted between the rows of fixtures, characterized in that each of the fixtures in at least any one of the rows has a contact type sensor mounted thereon in such a manner that it can be moved up and down freely.

The above and other advantages, manners and objects of the present invention will be apparent to those skilled in the art by having reference to the following description and the accompanying drawings in which a preferred embodiment of the principle of the present invention is shown by way of example only.

DESCRIPTION OF THE BEST MODE OF THE INVENTION

With reference to the accompanying drawings, a preferred embodiment of the present invention will now be described below.

Figure 1:
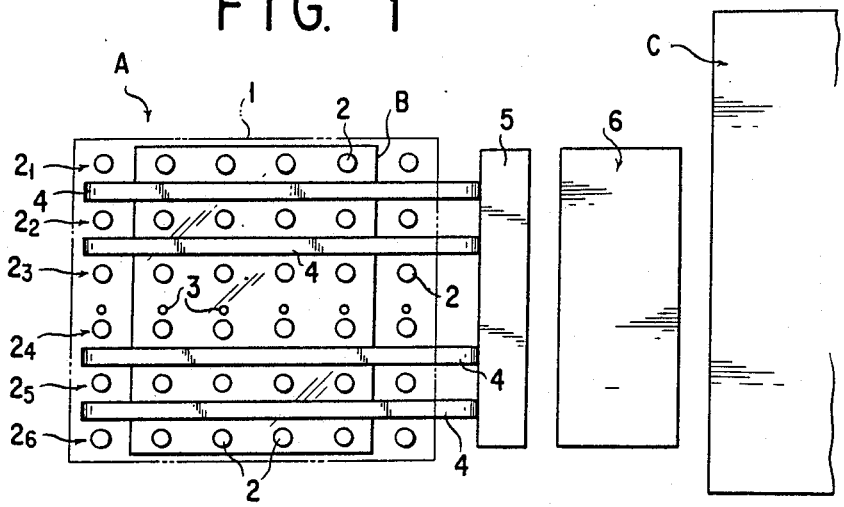
FIG. 1 is a schematic plan view showing the whole destacker provided with a double-blank detecting apparatus according to the present invention.

Referring to FIG. 1 which is a schematic plan view showing the whole destacker provided with a double-blank detecting apparatus according to the present invention, a frame 1 of a destacker A has rows $2_1$ to $2_6$ of attractor means mounted thereon in spaced-apart and parallel relationship with one another and in such a manner that they can be moved up and down freely, each of the rows of attractor means being parallel with the direction of conveyance of blanks and comprising a plurality of attractor means 2. Each of these attractor means comprises a vacuum cup or electromagnet. At least one of the rows $2_1$ to $2_6$ of attractor means, for example, each of the attractor means 2 in the row $2_4$ of attractor means is provided with a contact type sensor 3. Further, a plurality of rows of conveyor means 4 having attracting function such as conveyors provided with electromagnets or vacuum attractors etc. extend in parallel relationship with one another and with the direction of conveyance of blanks and between the rows $2_1$ to $2_6$ of actuator means.

Thus, the blanks B which have been attracted and lifted by the actuator means 2 are conveyed by conveyor means 4 under the attracted and lifted condition, and then fed by a roll feeder 5 installed at the terminal of the conveyor means 4 to a positioning mechanism 6. After the positioning of the blanks B has been made, they are conveyed by a blank supply means not shown to a press machine C located adjacent thereto where they ar subjected to working.

Figure 2:
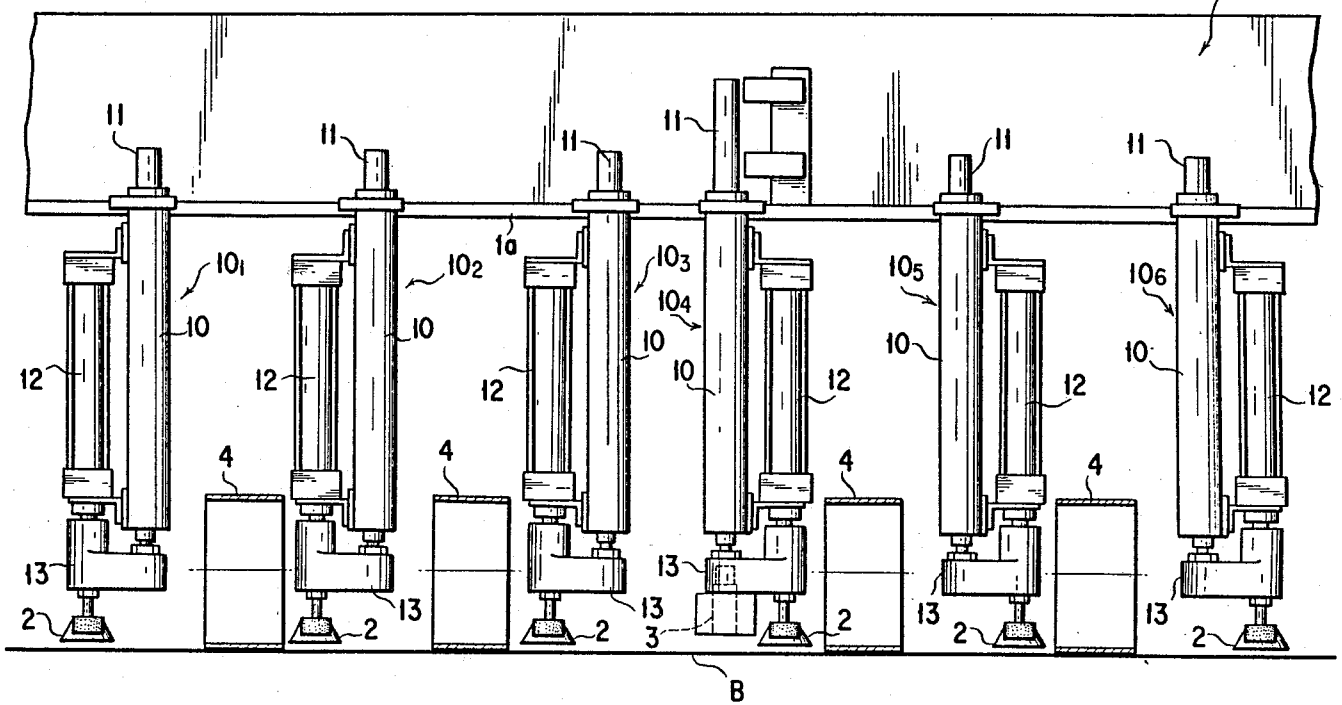
FIG. 2 is a schematic front view showing the double-blank detecting apparatus according to the present invention.

Stating in more details, as shown in FIG. 2, the upper cross member la of the frame 1 has guide rows $10_1$ to $10_6$ comprising a plurality of guides 10 which are hung down in the direction of conveyance (that is; the direction perpendicular to the space or the paper in FIG. 2) and in parallel relationship with one another. Each of these guides 10 has a sliding rod 11 which is inserted therein so as to slidably move in the vertical direction. Connected to the lowermost end of each of the sliding rods 11 is a fixture 13 which is adapted to be moved up and down by means of a lift cylinder 12 fixedly secured to each of the guides 10. This fixture 13 is fixedly secured to the aforementioned attractor means 2. Further, each of the fixtures 13 corresponding to the attractor means 2 in at least one of the rows $2_1$ to $2_6$ of attractor means as shown in FIG. 1, for example, the row $2_4$ of attractor means is provided with a contact type sensor 3.

Figure 3:
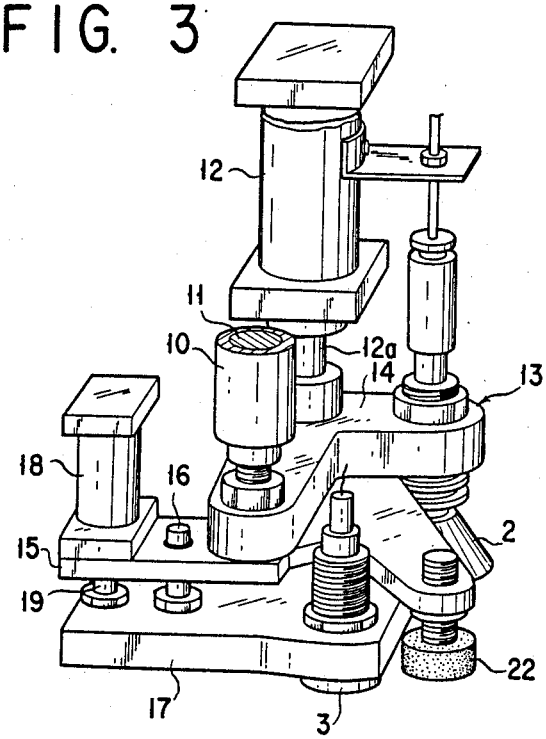
FIG. 3 is a schematic perspective view showing the double-blank detecting apparatus according to the present invention.
Figure 4:
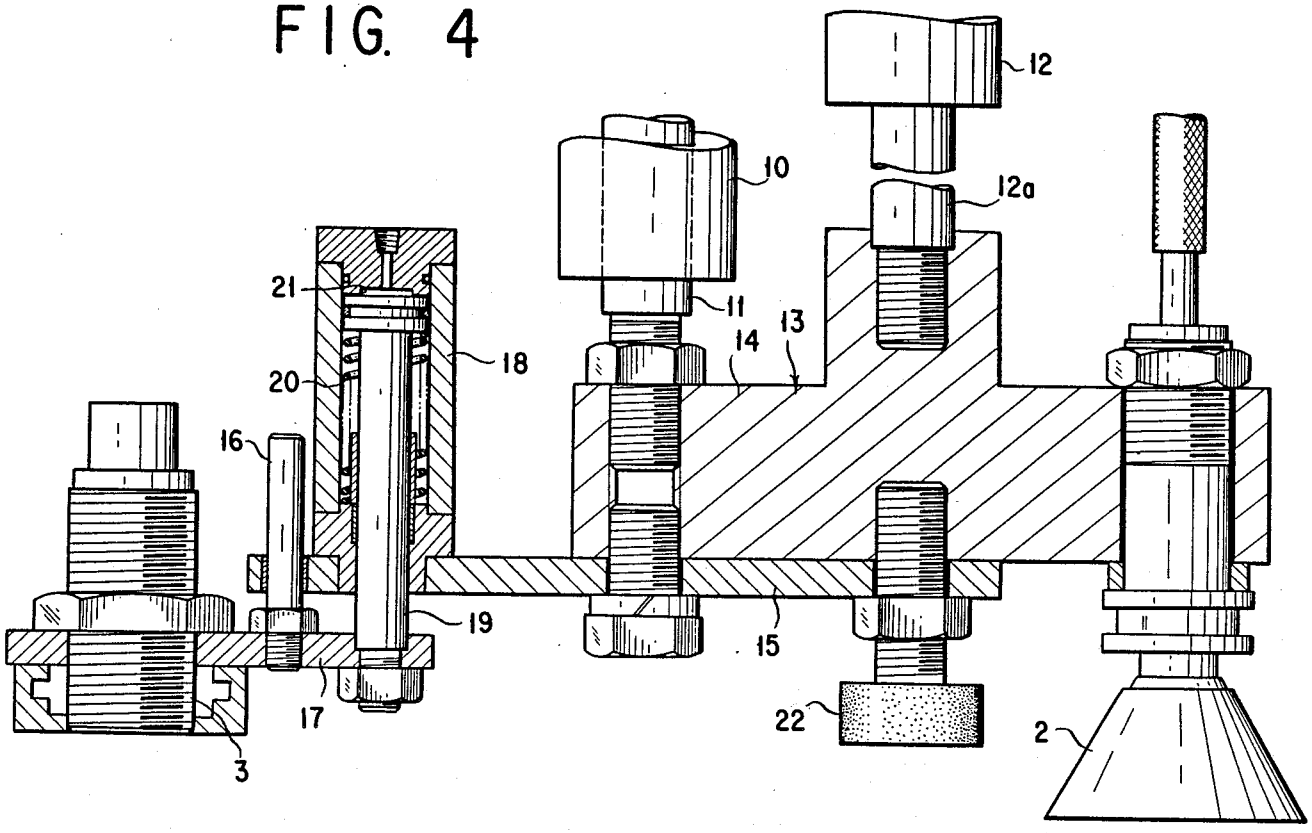
FIG. 4 is a developed longitudinal sectional view of the principal parts of the double-blank detecting apparatus according to the present invention shown in FIG. 3.

Stating in brief, as shown in FIGS. 3 and 4, each of the fixtures 13 having a contact type sensor 3 fitted thereto has an approximately L-shaped body 14, and an approximately V-shaped plate 15 whose base end is fixedly secured to the lower surface of the body 14. The body 14 is connected at the intermediate part thereof to a piston rod 12*a* of the lift cylinder 12. The body 14 has a downwardly extending attractor means 2 fixedly secured to one end thereof. Whilst, the other end of the body 14 has a sliding rod 11 fixedly secured thereto and which is slidably inserted in the guide 10. Further, one end of the plate 15 fixedly secured to the lower surface of the body 14 has a cylinder 18 fixedly secured thereto. The cylinder 18 has a piston rod 19 which passes slidably through the plate 15 so as to project down, and whose leading end is connected to one end of a guide block 17 on which a contact type sensor 3 is mounted. The contact type sensor 3 is mounted on the other end of this guide block in downwardly directed manner. Further, the plate 15 has a guide hole which is formed in the approximately central part thereof and in which a guide rod 16 projecting from the upper surface of the sensor mounting block 17 is loosely fit. The piston rod 19 within the cylinder 18 is normally biased upwardly by the force of a spring 20, and is arranged to project downwardly by the fluid under pressure supplied into a pressure chamber 21 thereof. Thus, the contact type sensor 3 can be moved up and down freely relative to the blank B which has been attracted by the attractor means, and also can always be held in a predetermined positional relationship with the attractor means. Therefore, it is possible to ensure the contact between the blank B and the sensor 3. Namely, the sensor 3 is caused to contact the blank B when the sensor mounting block 17 is lowered by the action of the cylinder 18. In more detail, after lowering the attractor means 2 to thereby effect the attraction hold of the blank B piled uppermost on a stack of sheet materials, the attractor means 2 with the blank B is then lifted by the action of the cylinder 12 so that the blank B is attracted and conveyed by the conveyor means 4. In the meantime, the sensor 3 is lowered by the action of the cylinder 18 to contact the blank B, thereby conducting the detection of the double-blank. In consequence an accurate detection of double blanks can be achieved.

Further, the member mounted on the other end of the plate 15 and denoted by reference numeral 22 is a stopper made of urethane rubber or the like and which serves to maintain the height of attracting the blank B by means of the attractor means 2 constant to thereby prevent possible deformation of blanks.

While the invention has been particularly shown and described in reference to prepared embodiments thereof, it will be understood by those skilled in the art that changes in form and details may be made therein without departing from the spirit and scope of the invention.

What is claimed is:

1. A double-blank detecting apparatus for use in a destacker, comprising a plurality of rows of fixtures, each of said rows of fixtures being parallel with the direction of conveyance of blanks and including a plurality of fixtures, each of said fixtures being mounted on the frame of the destacker in such a manner that it can be moved up and down by means of a lift cylinder; attractor means mounted on said fixtures, respectively; and a plurality of rows of conveyor means having attracting function extending in parallel relationship with one another and with the direction of conveyance of blanks and mounted between said rows of fixtures, and wherein each of said fixtures in at least any one of said rows has a contact type sensor mounted thereon in such a manner that it can be moved up and down freely relative to said blanks having been attracted by said attractor means, wherein each of said fixtures in connected at its intermediate portion with said lift cylinder, each of said fixtures having an approximately L-shaped body, one end of said body having a downwardly extending attractor means fixedly secured thereto, the other end of said body having a sliding rod which is fixedly secured thereto and which is inserted in a guide so as to slidably move up and down; and an approximately V-shaped plate, connected at the base portion to the lower surface of said body, said plate having a piston-cylinder unit which is fixedly secured to one end thereof and which has a piston rod adapted to slidably move up and down through said plate, said plate having a downwardly extending type sensor is connected through a mounting block to said piston rod, and said mounting block is mounted so as to be moved up and down freely by said piston-cylinder unit through a guide rod.

* * * * *